US005400810A

United States Patent [19]

Taylor

[11] Patent Number: 5,400,810

[45] Date of Patent: Mar. 28, 1995

[54] COMBINED CURLING IRON AND HAIR ROLLER

[75] Inventor: H. Roy Taylor, Stratford, Conn.

[73] Assignee: Conair Corporation, Stamford, Conn.

[21] Appl. No.: 136,017

[22] Filed: Oct. 14, 1993

[51] Int. Cl.[6] ..... A45D 1/04

[52] U.S. Cl. ..... 132/232; 132/227; 132/271; 219/225

[58] Field of Search ..... 132/232, 234, 271, 227; 219/222, 225, 226

[56] References Cited

U.S. PATENT DOCUMENTS

| | | | |
|---|---|---|---|
| 1,105,962 | 8/1914 | Carlson | 132/232 |
| 1,518,442 | 12/1924 | Ostermann | 219/225 |
| 3,918,465 | 11/1975 | Barradas . | |
| 4,145,600 | 3/1979 | Walter et al. . | |
| 4,443,688 | 4/1984 | Andis | 132/232 |
| 4,520,256 | 5/1985 | Doyle | 132/232 |
| 4,564,032 | 1/1986 | Araki | 132/232 |

FOREIGN PATENT DOCUMENTS 2241434 9/1991 United Kingdom .

*Primary Examiner*—John G. Weiss
*Attorney, Agent, or Firm*—Haynes N. Johnson

[57] ABSTRACT

A hot air curling iron is provided which can alternately be used as a curling iron or used to heat a hair roller. It has a spoon that is separate from the spoon control lever, but which has a common pivot with it. A releasable detent connects them. The unit normally operates as a curling iron. However, when a roller is placed over the curling iron barrel, the roller prevents the spoon from pivoting upwardly, so pressure on the control lever serves to release the detent. The lower portion of the control lever then serves as a clamp to hold the roller in place. Inwardly projecting detents on the roller serve to lock it in position over the clamp with the openings in the clamp aligned with those in the roller, permitting free air flow.

8 Claims, 4 Drawing Sheets

COMBINED CURLING IRON AND HAIR ROLLER

FIELD OF THE INVENTION

This invention relates to the field of personal care appliances, and, in particular, to cuffing irons and hair rollers, being a combination of the two.

BACKGROUND OF THE INVENTION

Various systems have been developed for using curling irons to heat hair rollers. In these systems, a hair roller is fitted over the barrel of a curling iron and held in place by the spoon of the curling iron fitting about the roller. This, of course, limits the use of the roller when in place. Also, if it is a hot air curling iron, this may block flow of air through portions of the iron. Examples of this design are found in Barradas U.S. Pat. No. 3,918,465 and Walter U.S. Pat. No. 4,145,600.

UK patent application 2,241,434A discloses a system for using a curling iron to heat hair rollers, but it eliminates the spoon on the curling iron, thus reducing its utility.

BRIEF SUMMARY OF THE INVENTION

The present invention overcomes the above difficulties by having a spoon that is separate from the control lever, but with the spoon and control lever having a common pivot. A releasable detent connects the spoon and control lever. When a roller is placed over the curling iron, it prevents the spoon from pivoting upwardly, so pressure on the control lever serves to release the detent and allows the control lever to pivot. The lower portion of the control lever then serves as a clamp to hold the roller in place. Inwardly projecting detents on the roller serve to lock it in position over the clamp with the openings in the clamp aligned with those in the roller, permitting free air flow.

DETAILED DESCRIPTION OF THE INVENTION

Figure 1:
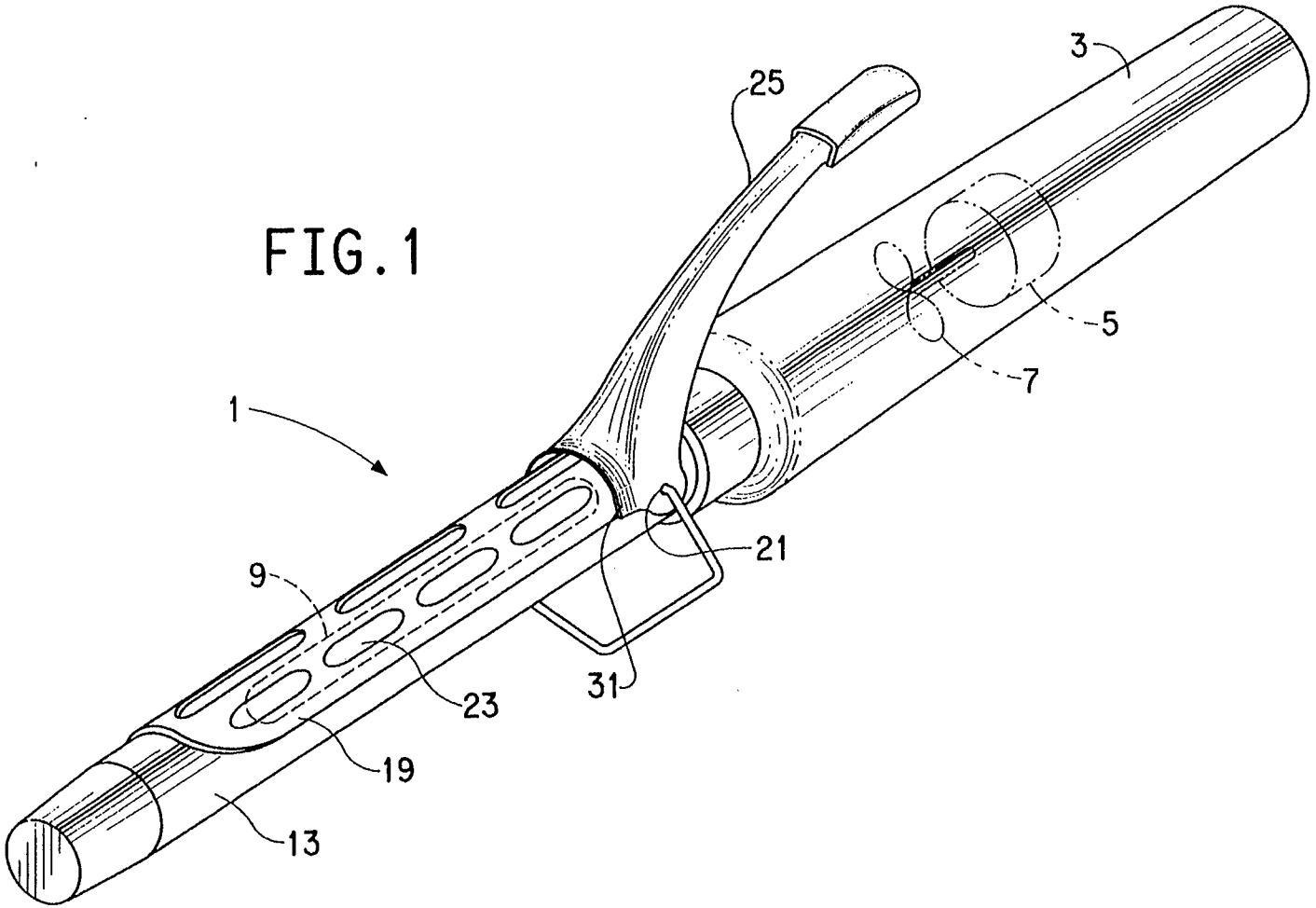
FIG. 1 is a perspective view of the curling iron of my invention.

My curling iron 1 has a handle 3 and a barrel 13, with some sort of heating element 9, such as a rope heater, in the barrel. If it is a hot air curling iron, it would also include a motor 5 and fan 7 in the handle; and the barrel would include openings 15 for the hot air.

Figure 2:
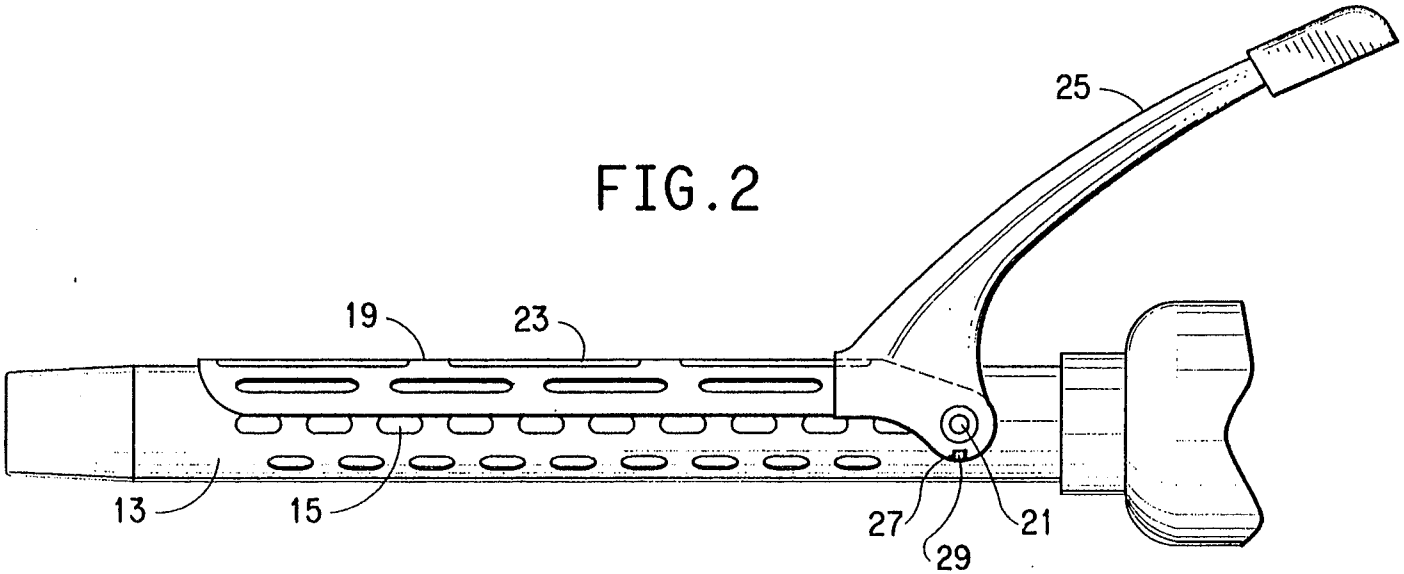
FIG. 2 is a side elevation showing the barrel with the spoon closed upon it.
Figure 3:
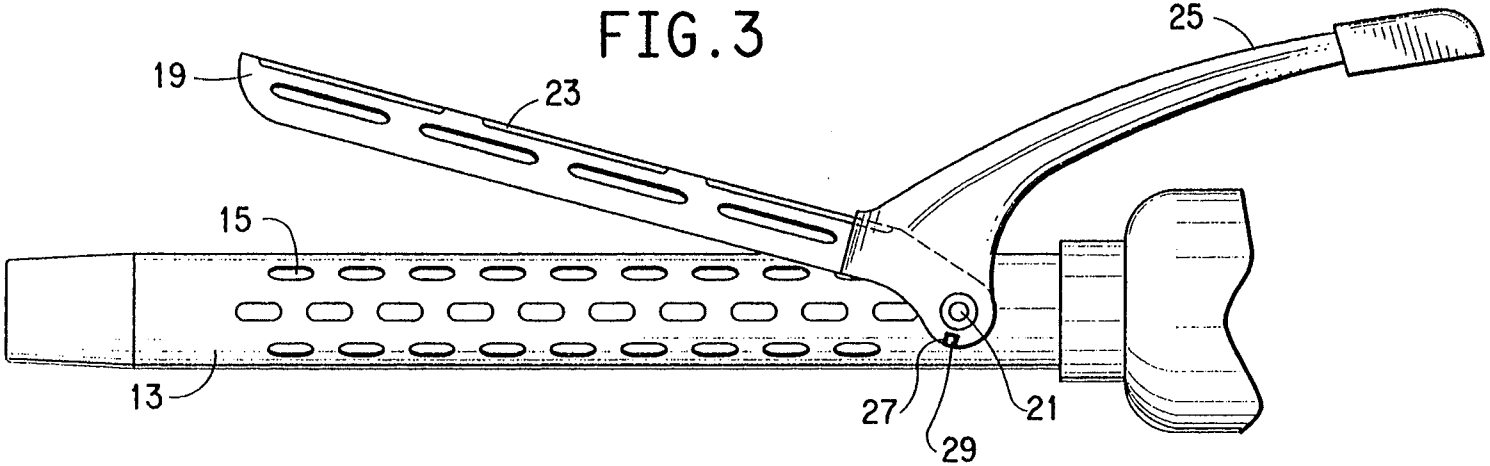
FIG. 3 is the same view showing the spoon opened, but with no hair roller on the barrel.

The unit includes a spoon 19 with air holes 23 (aligned with openings 15), the spoon being pivoted at pivot point 21. Associated with the spoon is a control lever 25 for controlling movement of the spoon. It, too, is pivoted at pivot point 21. Spoon 19 and control lever 25 are each spring-pressed to their closed positions, i.e., spring-pressed counterclockwise as viewed in FIGS. 2 and 3.

In contrast to the usual curling iron, spoon 19 and control lever 25 are not integral, but can pivot separately from one another. When the unit is used as a curling iron, the spoon and control lever operate together, since the control lever has a notch 27 to receive and interengage with a detent 29 carried by the spoon. When, however, a hair roller is placed over spoon 19, it prevents motion of the spoon. As a result, when pressure is then applied to the control lever, the detent 29 slips out of notch 27, permitting the control lever 25 to move independently of the spoon. Release of pressure on the control lever would allow the detent and notch to again engage one another.

Thus, when the user does not have a hair roller in place on barrel 13, pressure on control lever 25 serves to open spoon 19 in the usual manner. But when a hair roller is in place, spoon 19 cannot move and is released from control lever 25. As shown below, the control lever can then be used to grip the hair roller and hold it in place. Use of the notch and detent system means that the user does not have to remember to in some way release the control lever when a hair roller is used; and it also means that the control lever can be used independently of the spoon, in this instance to hold the hair roller in place. When the hair roller is removed from the barrel, the control lever and the spoon again interengage.

Figure 5:
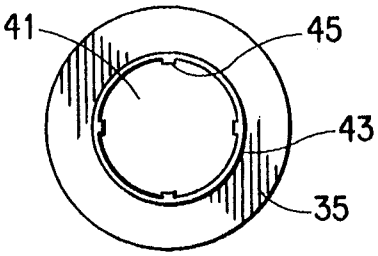
FIG. 5 is an end elevation of the hair roller.
Figure 4:
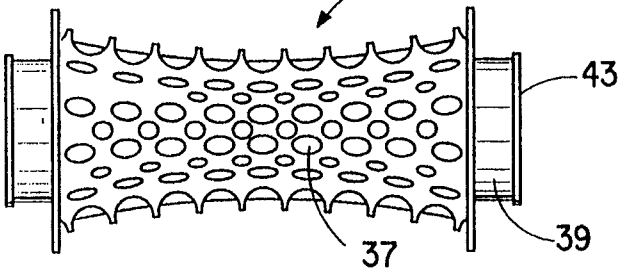
FIG. 4 is a side elevation of a hair roller of the type usable with my invention.
Figure 6:
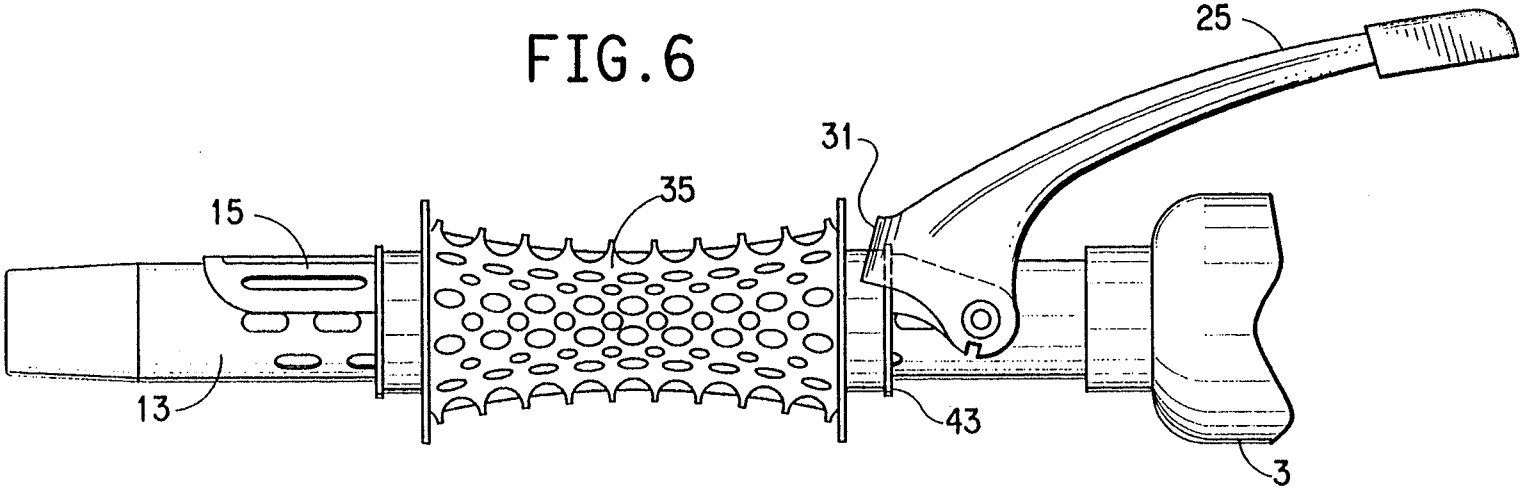
FIG. 6 is a side elevation of the hair roller in position over the barrel of the curling iron. Note that the roller is over the spoon and the control lever is disengaged from the spoon.
Figure 8:
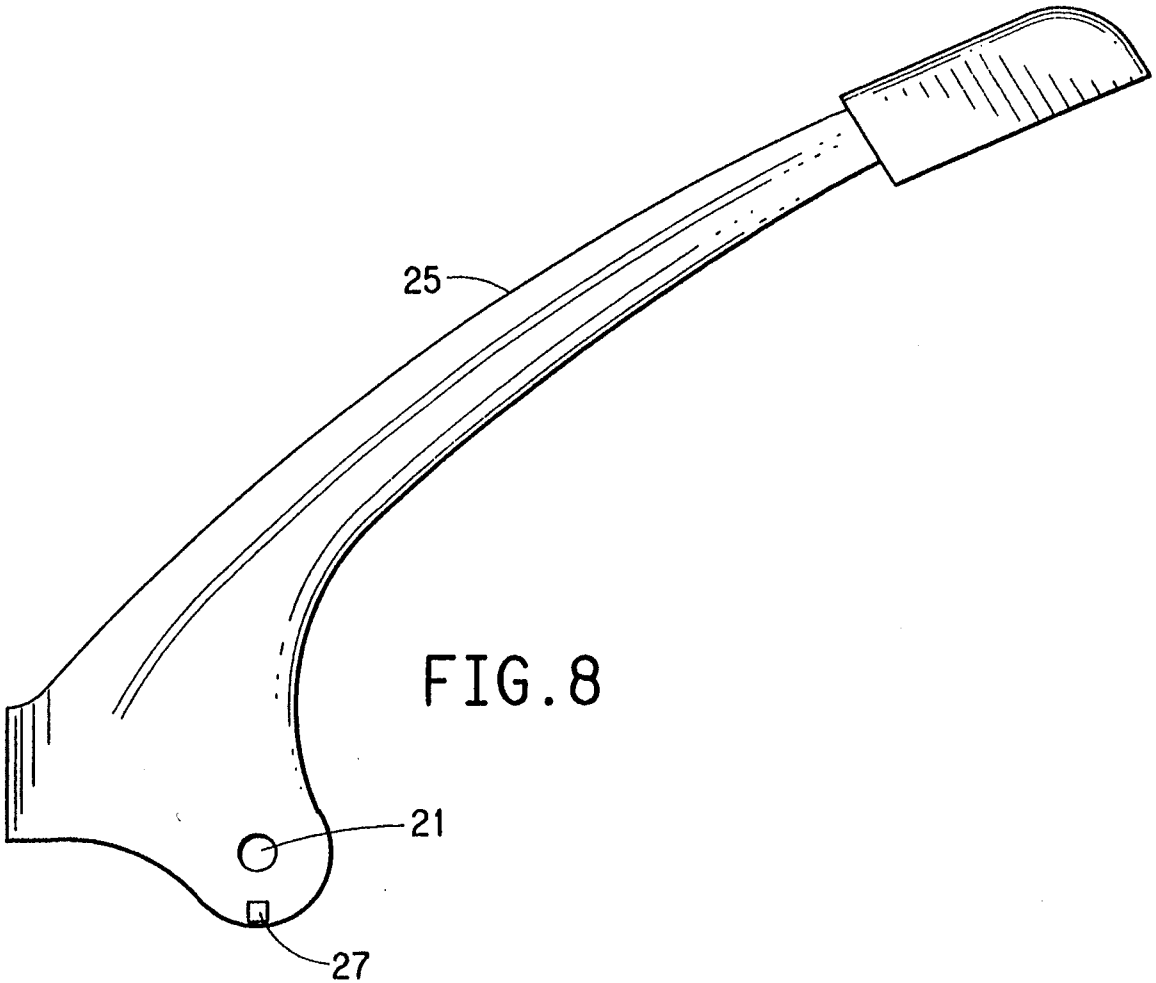
FIG. 8 is a side elevation of the control lever showing the detent structure.
Figure 7:
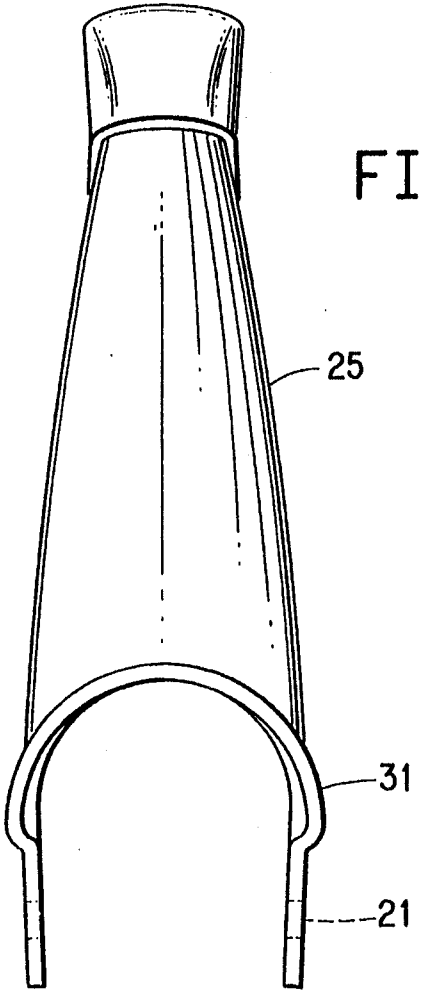
FIG. 7 is an end view of the control lever showing how the grip for a hair roller.

FIGS. 4 and 5 show a hair roller 35, such as used with my invention. The roller includes openings 37 which align with barrel openings 15 and spoon holes 23. It has a hub 39 at each end with a rim 43 on the hub. A bore 41 passes lengthwise through the roller. Detents 45 face inwardly from the hub and are positioned such that when they are fitted into spoon holes 23, roller openings 37 are in alignment with spoon holes 23, so that hot air can pass from the barrel through the spoon and then into the roller, to heat it.

Control lever 25 includes a bent portion on its lower end to form a grip 31 to fit about hub rim 43. Thus, when one places a roller on barrel 23 (over spoon 19), pressure on control lever 25 raises grip 31 to receive hub 39. Release of the control lever then permits grip 31 to clamp about rim 43 and hub 39, holding roller 35 in place. The roller can be released at any time simply by applying pressure to the control lever to lift the grip.

I claim:

1. A curling iron for use with hair rollers, said curling iron including a barrel, a pivot mounted on said barrel, a spoon, a control lever, said control lever not being integral with said spoon, said spoon and said control lever being pivoted about said pivot for movement about said pivot independently of one another, and self-releasing locking means interlocking said spoon and said control lever for common movement about said pivot, whereby said spoon and said control lever operate as a unit when no hair roller is fitted over said barrel, and said control lever is released from said self-releasing locking means when a hair roller is on said barrel and over said spoon and said control lever is pressed.

2. A curling iron as set forth in claim 1 in which said self-releasing locking means is a detent operatively associated with a complementary notch.

3. A curling iron as set forth in claim 1 including gripping means on said control lever proximate to said barrel, said gripping means being directed toward said barrel and, whereby said gripping means can fit over and grip a hair roller when said hair roller is positioned about said spoon.

4. A curling iron as set forth in claim 1 in which said curling iron is a hot air curling iron and includes air-flow openings in said barrel and corresponding air-flow openings in said spoon, said barrel air-flow openings and said spoon air-flow openings being aligned with one another.

5. A combination curling iron and hair roller, said curling iron including a barrel, a pivot mounted on said barrel, a spoon, a control lever, said control lever not being integral with said spoon, said spoon and said control lever being pivoted about said pivot for movement about said pivot independently of one another, and self-releasing locking means interlocking said spoon and said control lever for common movement about said pivot, said hair roller including a central bore dimensioned to fit about said barrel and said spoon, a hub about said bore, and gripping means on said control lever for gripping and holding said hub when said hair roller is positioned around said barrel and said spoon, whereby said spoon and said control lever operate as a unit when said hair roller is not fitted over said barrel, and said control lever is released from said self-releasing locking means when said hair roller is on said barrel and over said spoon and said control lever is pressed.

6. A combination as set forth in claim 5 in which said self-releasing locking means is a detent and an associated notch.

7. A combination as set forth in claim 5 in which said curling iron is a hot air curling iron and includes air-flow openings in said barrel and corresponding air-flow openings in said spoon, said barrel air-flow openings and said spoon air-flow openings being aligned with one another.

8. A combination as set forth in claim 7 in which said roller includes air-flow openings and includes means for aligning said roller air-flow openings with the other said openings.

* * * * *